US005967646A

United States Patent [19]

Engel

[11] Patent Number: 5,967,646

[45] Date of Patent: Oct. 19, 1999

[54] OVERHEAD LAMP WITH ELONGATED LIGHT SOURCE AND FLUX SPLITTING HOUR GLASS SHAPED GLOBE MOUNTED REFLECTOR

[76] Inventor: Hartmut S. Engel, Monrepos Strasse 7, Ludwigsburg, Germany, 71634

[21] Appl. No.: 08/842,662

[22] Filed: Apr. 15, 1997

[30] Foreign Application Priority Data

Apr. 17, 1996 [DE] Germany ..... 196 15 170

[51] Int. Cl.[6] ..... F21V 7/00

[52] U.S. Cl. ..... 362/296; 362/298; 362/365

[58] Field of Search ..... 362/217, 147, 362/297, 298, 300, 302, 346, 365, 296, 364

[56] References Cited

U.S. PATENT DOCUMENTS

| | | | |
|---|---|---|---|
| 931,673 | 8/1909 | Boyle | 362/147 |
| 1,286,535 | 12/1918 | Cochran | 362/147 |
| 5,483,424 | 1/1996 | Lightbody | 362/300 |
| 5,609,414 | 3/1997 | Caluori | 362/365 |

*Primary Examiner*—Sandra O'Shea
*Assistant Examiner*—Marshall Honeyman
*Attorney, Agent, or Firm*—Townsend and Townsend and Crew LLP

[57] ABSTRACT

A round reflector lamp is described in the form of a hanging lamp or built-in lamp in which the light flux emerging from the lighting means is split up by a reflector member which surrounds a predeterminable region of the free end of the elongate lighting means into a bundled, downwardly directed central light flux and into a radial light flux directed towards the round reflector.

10 Claims, 3 Drawing Sheets

OVERHEAD LAMP WITH ELONGATED LIGHT SOURCE AND FLUX SPLITTING HOUR GLASS SHAPED GLOBE MOUNTED REFLECTOR

FIELD OF THE INVENTION

The invention relates to a reflector lamp having a round reflector and a holder provided in the central region of the round reflector for an elongate lighting means which is received in the holder with a vertically extending axis.

BACKGROUND OF THE INVENTION

Reflector lamps of this kind are known both in the form of hanging lamps, and also in the form of built-in lamps.

OBJECT OF THE INVENTION

The object of the invention is to provide a reflector lamp with a round reflector which can be manufactured in an economical manner and which satisfies both the requirement for directed lighting of a region located beneath the lamp, and also the requirement for a mild and larger area spatial illumination.

BRIEF DESCRIPTION OF THE INVENTION

This object is satisfied essentially in that the light flux emerging from the lighting means is split up by a reflector member which surrounds a predeterminable region of the free end of the elongate lighting means into a bundled downwardly directed central light flux and into a radial light flux directed towards the round reflector.

Through the use of a reflector member surrounding the end region of the elongate lighting means which is provided with a fitting at one end, and through the special reflector characteristic of this member, it is possible to intentionally split up the light power that is available and, for example, to direct approximately 50% of the light flux directly downwardly via the reflector member to thereby provide a particularly well lit region, whereas the remaining light component passes, assisted by the reflector member, to the large area round reflector and is radiated from there in the form of a gentle light to illuminate a larger area region.

The reflector member is preferably rotationally symmetrically formed and is provided, starting from a region of minimal diameter in each case, i.e. starting from a restricted region, with a main section which broadens out downwardly and with an auxiliary section which broadens out upwardly, with the axial extent of the auxiliary section amounting to a fraction of the axial extent of the main section. The axial extent of the upwardly broadened auxiliary section can, for example, amount to a fifth of the axial extent of the main section, with the aperture width of the main section and of the auxiliary section of the reflector member preferably being substantially the same.

The reflector member is advantageously held in a glass body which receives the lighting means and which can be screwed to an installation base which surrounds the holder, i.e. by the attachment of the glass body; the reflector member is also simultaneously correctly positioned relative to the lighting means.

At the outer side of the glass body, in the holder region, there are provided a plurality of blend-out rings which preferably extend at an inclination to the lamp axis and which, on the one hand, ensure that the lighting means is screened against direct viewing and, on the other hand, can contribute to directing light coming from the lighting means to the round or circular reflector.

In order to achieve a particularly advantageous radiative behavior, the lower edge of the round reflector is preferably arranged in the radiative zone of the lighting means which is not surrounded by the reflector member. In this way, it is also ensured that the total light flux given off by the lighting means is intentionally exploited and is partly transmitted directly downwardly via the reflector member, or is led to the round reflector, with the intentional and defined radiative behavior that is aimed at being achieved thereby.

The reflector lamp in accordance with the invention can be formed both as a hanging lamp, and also as an built-in lamp. In the case of the reflector lamp being formed as a built-in lamp, it is particularly advantageous to rotatably mount clamping screws adjacent to the holder and accessible from the side of the holder and, via the screws, to adjust a clamping slide to which flexible draw members are secured, which serve to actuate rocker levers, which are pivotally mounted at the rim on the rear side of the round reflector and serve to clamp the round reflector rim to the edge region of a wall or ceiling cut-out. In this manner, a particularly simple and reliable installation is made possible and it is only necessary to actuate the easily accessible clamping screws, so that it can also be ensured that the installation can take place without contamination of or damage to the sensitive reflector surface.

DESCRIPTION OF THE PREFERRED EXEMPLARY EMBODIMENTS

Figure 1:
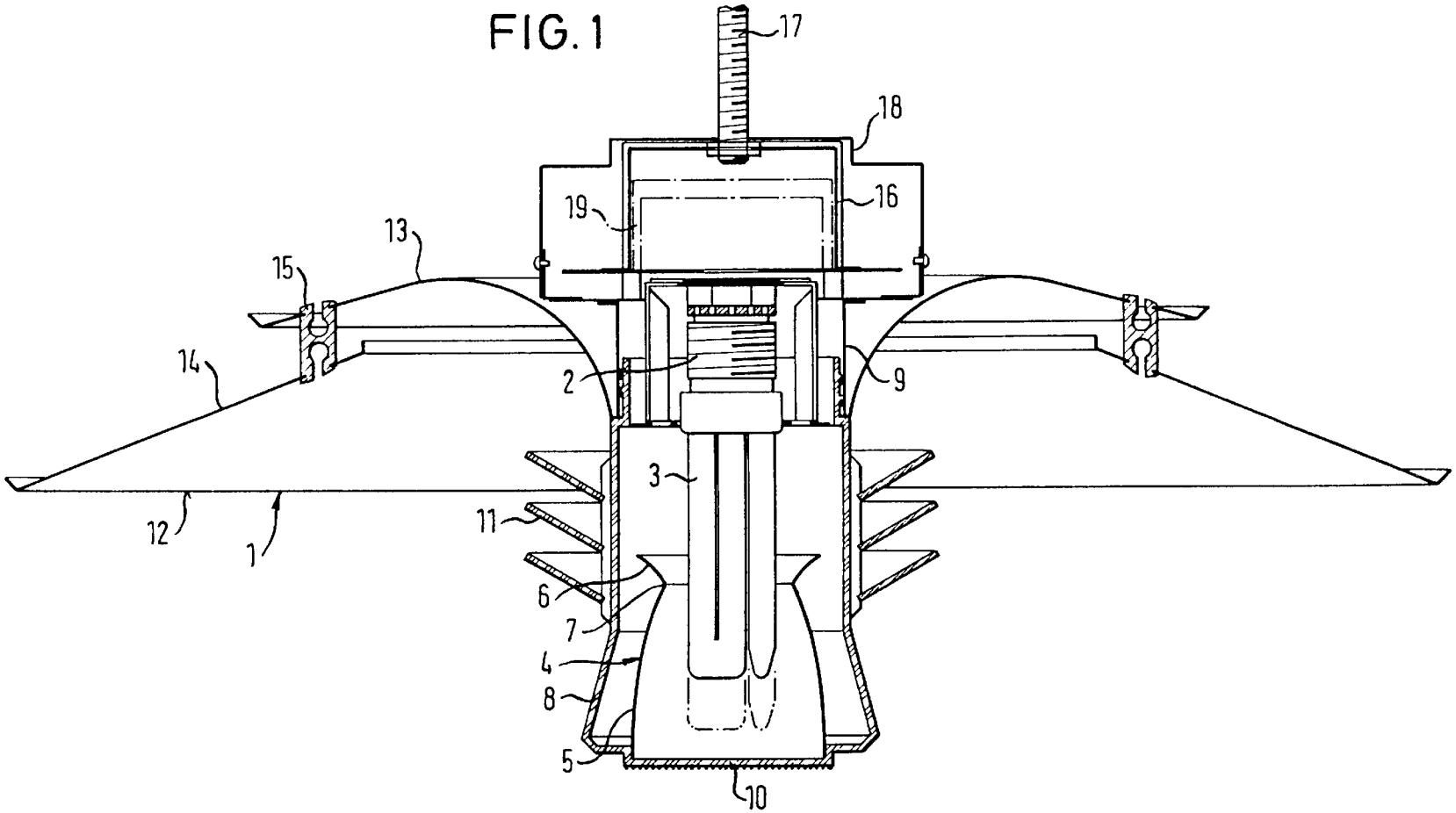
FIG. 1 is a schematic, axially sectioned view of a hanging reflector lamp formed in accordance with the invention.

FIG. 1 shows a reflector lamp having a round reflector 1 at the center of which there is arranged a holder 2 for an elongate lighting means 3, in particular for an energy saving lamp with a mounting fitting at one end. The holder 2 is arranged within a chamber-like installation base 9, with the round reflector 1 extending outwardly from the lower end of the installation base 9. This chamber-like installation base 9 is provided with an internal thread into which a glass body 8, which is closed at one end and which surrounds the lighting means 3, can be screwed. A reflector member 4 is mounted in the glass body 8 in a base side recess 10 and extends over a predeterminable portion of the free length of the lighting means 3, for example over approximately half the free length of this lighting means 3. The reflector member 4 is rotationally symmetrically formed and includes, starting from a region 7 of the minimum diameter in each case, a main section 5 which broadens out downwardly and an auxiliary section 6 which broadens out upwardly. Both sections are broadened to at least substantially the same diameter, with the main section 5 being convexly curved and with the auxiliary section 6 being of concave curvature.

The glass body 8 also has a cylindrical region disposed at the holder end and a region which broadens towards the free end, with a plurality of blend-out rings 11 being arranged in an inclined manner at the outer side of the glass body in the cylindrical region and including-when considered from the side of the holder-an acute angle with the axis of the reflector lamp.

The lower edge of the round reflector 1 lies substantially lower than the holder 2 and is preferably located in the region of the part of the lighting means 3 not surrounded by the reflector member 4.

The blend-out rings 11 have the additional advantage, and can also be specially so designed, that a predeterminable proportion of the light flux is directed, in the in-built version of the lamp, beyond the reflector region directly towards the wall or ceiling into which the in-built lamp is integrated, so that a desired brightening of the ceiling or wall results.

The round reflector 1 is of two-part construction in the embodiment of FIG. 1 and is composed of a central reflector 13 connected to the installation base 9, and also of a reflector ring 14 which is connected to the central reflector 13 via spacers 15, so that light can also emerge between the central reflector 13 and the reflector ring 14.

Above the holder 2, and in connection with installation base 9, there is formed a box part 18 in which a receiving space 16 for an electronic unit 19 is located and via which the hanging lamp 17 is also secured.

Through the arrangement and design of the reflector member 4 which surrounds the lighting means over a portion of its length, the respectively desired light component, which can for example amount to about 50%, is directed centrally downwardly, while a larger area illumination of the room with gentle light is obtained as a result of the light passing directly from the lighting means 3 to the round reflector 1 and of the light directed upwardly to the round reflector 1 from the auxiliary section 6 of the reflector member 4. In this respect the desired splitting up of the light can be influenced by a suitable design and positioning of the reflector member 4.

Although the glass body 8 is preferably formed as a glass or plastic body closed at one end, an arrangement open at one end can also basically be used.

Figure 2:
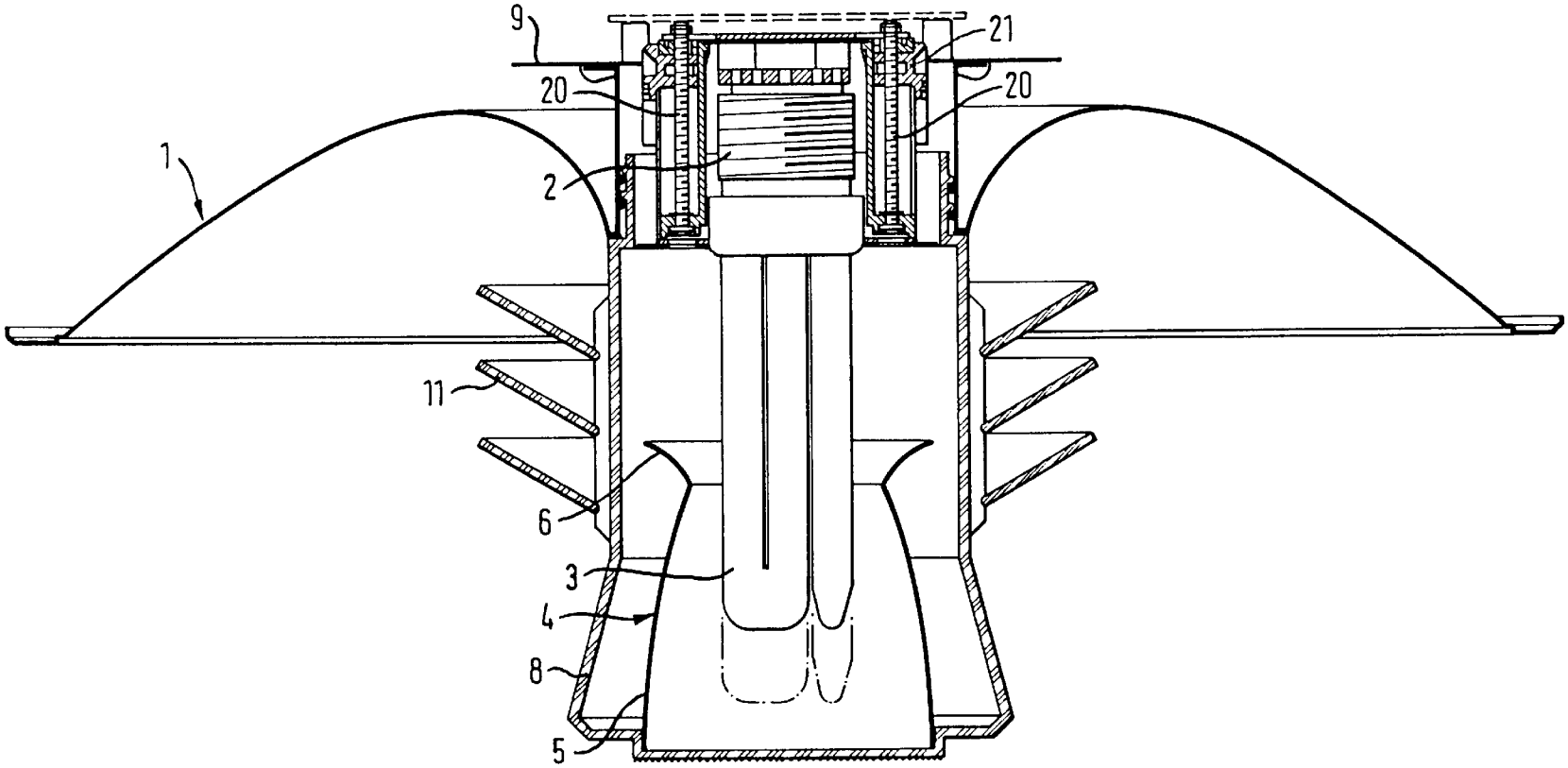
FIG. 2 is a schematic, axially sectioned representation of a reflector lamp in accordance with the invention formed as a built-in lamp.

In FIG. 2 a built-in version of the round reflector lamp of FIG. 1 is shown, with parts which correspond to one another being provided with the same reference numerals.

The round reflector 1 is, in this case, formed in one piece and provided with an outer rim region which can be clamped to the edge region of a cut-out in a ceiling or wall, in order to fix the lamp in position. For this purpose, the built-in version of the round reflector lamp is equipped with a special tensioning and clamping system.

Figure 3:
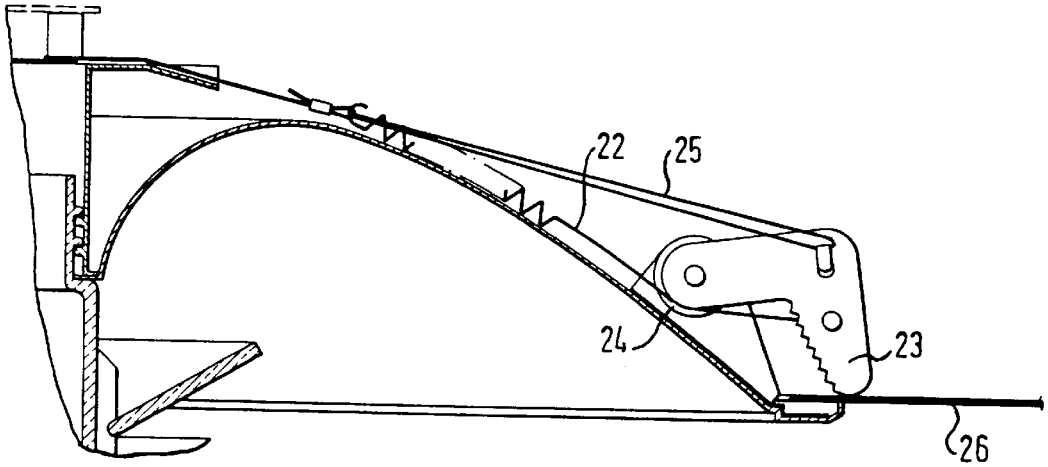
FIG. 3 is a part sectional illustration to explain the fastening system for the in-built version of FIG. 2.

Two diametrically oppositely disposed clamping screws 20 which are rotatably mounted are provided adjacent to the holder 2 and, in each case, a clamping slide 21 is vertically movable on the clamping screws by rotation of these clamping screws 20. A flexible draw member 22 is connected to each of the clamping slides 21, with its two free ends each being pivotally connected to a rocker lever 23 which can be seen in the part-sectional illustration of FIG. 3. Each of the total of four rocker levers, which are arranged uniformly distributed over the periphery is connected to the draw member 22 via a deflection roller 24, so that a tensioning of the draw members 22 takes place on actuation of the clamping screws 22 and a downward movement of the associated clamping slide 21 caused thereby. As a result, the rocker levers are thereby pressed against the edge of the wall 26 adjacent to the respective wall cut-out, so that the desired clamping of the reflector rim to the outer side of the wall, and thus the corresponding fixing of the built-in lamp takes place. On releasing the rocker levers, and also in the rest position, the rocker levers 23 are pivoted upwardly by corresponding rubber pulls or bands 25, so that they are disposed within the outer peripheral contour of the lamp and do not hinder the insertion of the lamp into the respective recess.

It is of substantial advantage in connection with this type of attachment that it enables a problem-free and rapid fixation of the built-in lamp from the side of the holder and that the sensitive reflector surface does not have to be touched during the installation, so that corresponding dangers of damage and contamination are not present.

What is claimed is:

1. A reflector lamp comprising:

a round reflector;

a holder provided in a central region of the round reflector;

elongate lighting means that is received in the holder, the elongate lighting means defining a vertically extending axis;

a reflector member that surrounds a predeterminable region of a free end of the elongate lighting means; and a glass body that receives the elongate lighting means;

wherein the reflector member is mounted in the glass body;

wherein the glass body is configured such that it may be screwed to a mounting base that surrounds the holder; and wherein light flux emerging from the elongate lighting means is split up by the reflector member into a bundled downwardly directed central light flux and into a radial light flux directed toward the round reflector.

2. A reflector lamp in accordance with claim 1 wherein a free end of the reflector member is held in form-fitted manner in a base side recess of the glass body.

3. A reflector lamp in accordance with claim 1 further comprising a plurality of blend-out rings that are inclined to the lamp axis at an outer side of the glass body in a region of the holder end.

4. A reflector lamp in accordance with claim 1 wherein the reflector member is of rotationally symmetrical shape that includes a main section extending from a region of minimal diameter that broadens out downwardly and an auxiliary section that broadens out upwardly and has an axial extent that amounts to a fraction of an axial extent of the main section.

5. A reflector lamp in accordance with claim 4 wherein aperture widths of the main section and the auxiliary section are substantially the same.

6. A reflector lamp comprising:

a round reflector;

a holder provided in a central region of the round reflector;

elongate lighting means that is received in the holder, the elongate lighting means defining a vertically extending axis;

a reflector member that surrounds a predeterminable region of a free end of the elongate lighting means; and a plurality of blend-out rings that are inclined to the lamp axis in a region of an end of the holder;

wherein light flux emerging from the elongate lighting means is split up by the reflector member into a bundled downwardly directed central light flux and into a radial light flux directed toward the round reflector.

7. A reflector lamp in accordance with claim 6 wherein a lower edge of the round reflector is disposed in a radiative region of the elongate lighting means not surrounded by the reflector member, the lower edge being disposed in a region of the blend-out rings.

8. A reflector lamp comprising:

a round reflector, the round reflector comprising a central reflector and a reflector ring that is connected to the central reflector via spacers;

a holder provided in a central region of the round reflector;

elongate lighting means that is received in the holder, the elongate lighting means defining a vertically extending axis; and a reflector member that surrounds a predeterminable region of a free end of the elongate lighting means;

wherein light flux emerging from the elongate lighting means is split up by the reflector member into a bundled downwardly directed central light flux and into a radial light flux directed toward the round reflector.

9. A reflector lamp formed as a hanging lamp and comprising:

a round reflector;

a holder provided in a central region of the round reflector;

elongate lighting means that is received in the holder, the elongate lighting means defining a vertically extending axis;

a reflector member that surrounds a predeterminable region of a free end of the elongate lighting means;

clamping screws that are rotatably held adjacent to the holder, the clamping screws being accessible from a side of the holder and allowing for adjustment of the clamping sides; and rocker arms that are pivotively journalled at a rim at a rear side of the round reflector, the rocker arms being actuated by flexible draw members, due to adjustment of the clamping slides, to clamp the round-reflector into a wall or ceiling recess.

10. A reflector lamp in accordance with claim 9 further comprising a receiving space for an electronic ignition and control apparatus formed as an installation unit above the holder.

* * * * *